United States Patent [19]

Caisander

[11] 4,180,381

[45] Dec. 25, 1979

[54] MEANS FOR TILTING CRUCIBLE FURNACES

[75] Inventor: Yngve Caisander, Helsingborg, Sweden

[73] Assignee: ASEA Aktiebolag, Vesteras, Sweden

[21] Appl. No.: 880,541

[22] Filed: Feb. 23, 1978

[30] Foreign Application Priority Data

Feb. 28, 1977 [SE] Sweden ..... 7702148

[51] Int. Cl.[2] ..... F27B 14/02

[52] U.S. Cl. ..... 432/157; 432/160

[58] Field of Search ..... 432/156, 157, 158, 160

[56] References Cited

U.S. PATENT DOCUMENTS

| | | | |
|---|---|---|---|
| 1,129,983 | 3/1915 | Iler | 432/158 |
| 2,018,586 | 10/1935 | Wetherill, Jr. et al. | 432/157 X |
| 3,790,338 | 2/1974 | Duca | 432/157 X |
| 4,045,202 | 8/1977 | Claisse | 432/157 |

*Primary Examiner*—John J. Camby

*Attorney, Agent, or Firm*—Watson Cole Grindle & Watson

[57] ABSTRACT

A tilting device for tilting crucible furnaces is supported in a stand wherein a yoke mounts the crucible furnace to the stand and is pivotable about a shaft extending transverse to the opening of the crucible furnace. The shaft is supported in movable guide tubes mounted within respective upstanding members of the stand. The movable guide tubes are releasably locked within the upstanding members such that operation of a lifting device causes the crucible and yoke to rotate about the shaft and release of the locking means causes the crucible and yoke to be lifted from the stand with operation of the lifting device and movement of the guide tubes within the upstanding members.

4 Claims, 2 Drawing Figures

MEANS FOR TILTING CRUCIBLE FURNACES

BACKGROUND OF THE INVENTION

1. Field of the Invention

The present invention relates to means for tilting crucible furnaces around a tilting shaft eccentrically positioned with respect to the crucible.

2. Prior Art

In conventional crucible furnaces it is desirable to be able to lift up the crucible in order to be able to exchange a consumed crucible in a suitable manner, for example after chopping or other working such as boring, through an aperture provided in the crucible bottom, or by detaching the crucible from the furnace. The consumed goods are then to be collected in a container below the furnace, suitably in a manner which is beneficial to the environment, for example according to British Pat. No. 1,448,954. To perform such an operation, it is necessary either to lift up the crucible in a suitable manner, or to work in a cavity below the furnace. Alternatively, the crucible material has to be shovelled away after being broken from the furnace, which is then either in its normal position or in a tilted position.

SUMMARY OF THE INVENTION

The means according to the present invention provides a solution to the aforementioned problems and other problems associated therewith by providing a crucible tilting means with locking devices at the tilting shaft of the crucible. The crucible is provided with lifting cylinders for tilting the crucible around a tilting axle, the locking devices being releasable thus enabling the crucible to be lifted up vertically by means of the lifting cylinders. In this way, after lifting up and utilizing the ordinary tilting cylinder, the crucible can be released in a simple manner, for example through the furnace bottom into a space-demanding collecting vessel adjacent to a low stand, for example of the L-type, placed on the floor.

BRIEF DESCRIPTION OF THE DRAWINGS

The invention is exemplified in more detail in the accompanying drawing, wherein.

DETAILED DESCRIPTION

Figure 1:
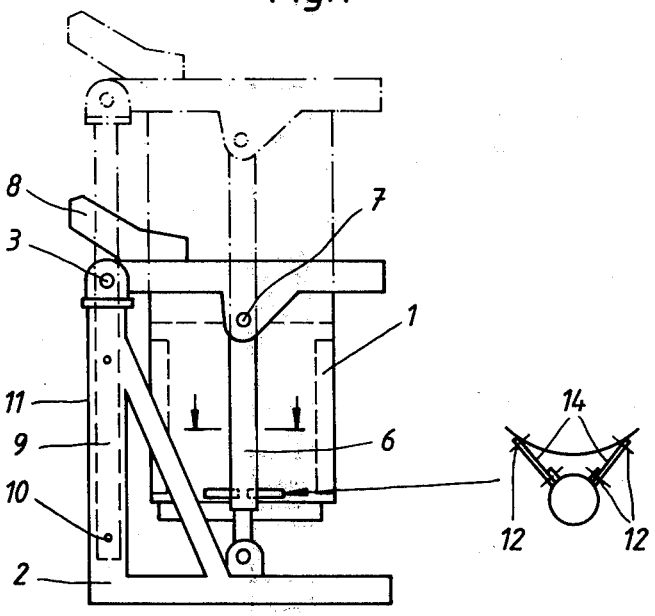
FIG. 1 shows a crucible furnace with the crucible in operating position and in raised position.
Figure 2:
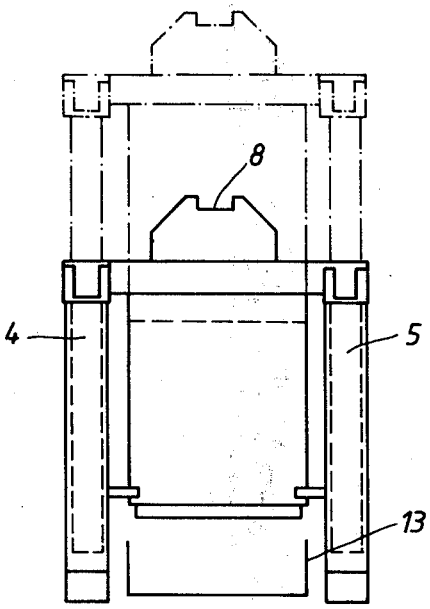
FIG. 2 shows the same device seen from another side.

In FIG. 1, crucible furnace 1 is mounted in an ordinary stand 2, for example of the L-type. The furnace is mounted to be tilted around tilting shaft 3 using one or more bearings of the usual type. In this case furnace 1 is journalled around shaft 3 passing between two legs 4, 5 (see FIG. 2) in L-stand 2. The tilting is performed by means of two mutually diametrically placed tilting cylinders 6 adapted either for hydraulic or pneumatic operation. The tilting cylinders 6 are connected to a yoke at points 7, one on either side of stand 2. Upon tilting, crucible furnace 1 is tilted around shaft 3 and melt runs from spout 8. Tilting shaft 3, with its tilting bearings, is connected with a guide 9 retained at point 10 (a similar device being located at the other end of the furnace).

In accordance with the inventive concept, it is desirable to be able to use the ordinary lifting cylinders 6 for lifting furnace 1 to a position where a used crucible can be pulled down in a simple manner. In this connection locking devices 10 can be released, whereupon, on starting the lifting cylinders 6, crucible 1 is lifted up to the position shown by dashed lines according to FIGS. 1 and 2. Guide 9 then runs in a guide tube or a guide cylinder 11 (one on either side, each corresponding to one guide), and control of the lifting movement is maintained to the upper position. Before the lifting movement has started, crucible 1 is locked to operating cylinder 6 by a locking device (shown to the right of FIG. 1) and consists of a number of fastening screws 12 and guide rods 14, so that no tilting movement can be performed during the lifting. The lifting of the crucible to the upper position thus takes place by means of cylinders 6, but in certain cases, of course, separate lifting devices can be used for this purpose. When the crucible has been lifted to the upper position, it can be pulled down in the manner stated above, for example by pressing the crucible out of the furnace down into the collecting vessel 13, suitably protected by a dust cover in the lateral direction, so that the crucible can be released in a suitable manner with regard to the environment. Release of the crucible can also take place through a hole in the bottom and by boring the crucible furnace.

It is also possible, of course, to remove only part of the crucible, whereafter a new compound is rammed into the crucible. The number of lifting cylinders may be more than the two shown, and the arrangement of fastening screws 12 is only one of a large number of possible ways of solving the problems of attachment to the cylinder. Some forms of lockable guide arranged at the crucible side would also be possible, running together with the hydraulic cylinder up to the releasing position of the crucible. The tilting bearings of the furnace are attached, for example, to two inner tube guides 9, which during normal operation, can be locked in their lower position for normal tilting, for example by means of locking pin 10. When releasing the locking device and applying the four guide rods between the cylinder casing and the furnace body by means of a screw (see the separate Figure to the right of FIG. 1), the whole furnace body can thus be lifted straight up, and the maximum lifting height is then equal to the cylinder stroke. The crucible can then be released, as mentioned, directly into the collecting vessel 13 located below the furnace. The guide rods 14 can be used, besides for locking the movement in the tilting direction, for equalizing pressure differences from cylinders 6. The collecting vessel can be placed either in a cavity or on a plain floor, and in the latter case the furnace is raised.

What is claimed is:

1. A tilting device for tilting a crucible furnace, comprising:

a stand with supporting means for carrying the crucible furnace;

a yoke for mounting said crucible furnace to said stand and being pivotable about a shaft extending transverse to the opening of said crucible furnace;

movable guide tubes supporting said shaft and respectively mounted within upstanding members of said stand;

means for lifting said crucible and yoke;

means for releasably locking said movable guide tubes within said upstanding members whereby operation of said means for lifting causes said crucible and yoke to rotate about said shaft; and release of said locking means causes said crucible and yoke to be lifted from said stand with operation of said lifting means and movement of said guide tubes within said upstanding members.

2. A tilting device as in claim 1 further comprising means for preventing tilting of said crucible furnace about said shaft.

3. A tilting device as in claim 2 wherein said means for lifting includes two fluid operated lifting cylinders extending between said yoke and said stand with each lifting cylinder being positioned on opposite sides of said crucible furnace, and said means for preventing tilting includes guide rods extending from each of said lifting cylinders and engaging said crucible furnace.

4. A tilting device as in claim 3 wherein said stand is of the L-type and said movable guide tubes are mounted within the upstanding arm of said L-type stand.

* * * * *